US006690905B2

(12) United States Patent
Takahashi et al.

(10) Patent No.: US 6,690,905 B2
(45) Date of Patent: Feb. 10, 2004

(54) IMAGE FORMING APPARATUS INCLUDING INTERMEDIATE TRANSFER ELEMENT FOR PREVENTING OCCURRENCE OF WHITE SPOT

(75) Inventors: Mitsuru Takahashi, Kawasaki (JP); Tetsuroh Miura, Katsushika-ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/197,564

(22) Filed: Jul. 18, 2002

(65) Prior Publication Data

US 2003/0026631 A1 Feb. 6, 2003

(30) Foreign Application Priority Data

Jul. 18, 2001 (JP) ..... 2001-218684

(51) Int. Cl.[7] ..... G03G 15/01
(52) U.S. Cl. ..... 399/302; 430/111.41
(58) Field of Search ..... 399/302, 308; 430/111.1, 111.4, 111.41

(56) References Cited

U.S. PATENT DOCUMENTS

| | | | |
|---|---|---|---|
| 5,870,650 A | 2/1999 | Takahashi et al. | |
| 5,923,937 A | 7/1999 | Thompson et al. | |
| 6,035,157 A | 3/2000 | Takahashi et al. | |
| 6,405,002 B2 * | 6/2002 | Ogiyama et al. | 399/302 |

FOREIGN PATENT DOCUMENTS

| | | |
|---|---|---|
| EP | 0 743 572 | 11/1996 |
| JP | 59-50473 | 3/1984 |
| JP | 8-15979 | 1/1996 |
| JP | 8-80634 | 3/1996 |
| JP | 8-146668 | 6/1996 |
| JP | 8-262785 | 10/1996 |
| JP | 11-344851 | 12/1999 |
| JP | 2000-330390 | 11/2000 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus including at least one latent image carrier that carries an electrostatic latent image, at least one developing device that develops the electrostatic latent image with developer to form a toner image on the at least one latent image carrier, and an intermediate transfer element including an elastic layer that carries the toner image transferred from the at least one latent image carrier. The image forming apparatus further includes a primary transfer device that transfers the toner image on the at least one latent image carrier onto the intermediate transfer element, and a secondary transfer device that transfers the toner image carried by the intermediate transfer element onto a transfer material. The developer includes toner and magnetic carrier, and a weight average particle diameter of the magnetic carrier is in a range of 10 $\mu$m to 80 $\mu$m.

8 Claims, 9 Drawing Sheets

IMAGE FORMING APPARATUS INCLUDING INTERMEDIATE TRANSFER ELEMENT FOR PREVENTING OCCURRENCE OF WHITE SPOT

CROSS-REFERENCE TO RELATED APPLICATIONS

The present application claims priority to Japanese Patent Application No. 2001-218684 filed in the Japanese Patent Office on Jul. 18, 2001. The contents of that application are incorporated herein by reference in their entirety.

BACKGROUND OF THE INVENTION

1. Field of the Invention

The present invention relates to an image forming apparatus such as a copying machine, a facsimile machine, a printer, or other similar image forming apparatus, and more particularly to an image forming apparatus that forms images using an intermediate transfer element including an elastic layer.

2. Discussion of the Background

In a known image forming apparatus, to form a toner image on a transfer material such as a transfer sheet, a latent image is first formed on a surface of a photoreceptor serving as a latent image carrier. Subsequently, the latent image on the photoreceptor is developed with toner, and then a toner image is transferred onto the transfer material. The transferred toner image is fixed onto the transfer material by heat and pressure in a fixing device, and thereby a print image is obtained.

In the case of a full-color image forming apparatus, four color toner images, such as black (BK), yellow (Y), magenta (M), cyan (C) toner images, formed on a photoreceptor are transferred onto an intermediate transfer element by each color by a primary transfer device (transfer from the photoreceptor to the intermediate transfer element may be hereinafter referred to as a "primary transfer"). The transferred color toner images are superimposed on each other on the intermediate transfer element. Subsequently, the superimposed color toner image is collectively transferred onto a transfer material by a secondary transfer device (transfer from the intermediate transfer element to the transfer material may be hereinafter referred to as a "secondary transfer").

The color toner image transferred onto the transfer material is fixed by a fixing device, and thereby a full-color image is obtained. As compared with an image forming apparatus in which a toner image is directly transferred onto a transfer material from a photoreceptor, the above-described full-color image forming apparatus using the intermediate transfer element has advantages in improving a defective image due to deviation of the position of color toner images at the time of superimposing each other, and an inferior transfer due to the difference in characteristics of transfer materials, etc. Therefore, such an image forming apparatus using an intermediate transfer element has been widely used.

As an example of an image forming apparatus using an intermediate transfer element, there is a so-called tandem type image forming apparatus including a plurality of photoreceptors and an intermediate transfer element. Specifically, the tandem type image forming apparatus includes a plurality of photoreceptors arranged in a line along a moving direction of an intermediate transfer element, and developing devices that respectively develop latent images on the photoreceptors with toner of respective colors. The respective color toner images formed on the photoreceptors are sequentially transferred onto the intermediate transfer element and superimposed on each other.

In the tandem type image forming apparatus, a space is required for arranging a plurality of photoreceptors in a line. To save space and reduce costs, the tandem type image forming apparatus often employs a belt-shaped intermediate transfer element. As compared to a drum-shaped intermediate transfer element, the belt-shaped intermediate transfer element has advantages in numerous layouts of devices in the image forming apparatus and in reducing the size and costs of the apparatus.

Further, the tandem type image forming apparatus includes a secondary transfer device that transfers a superimposed color toner image formed on the intermediate transfer element onto a transfer material. Specifically, the secondary transfer device includes a secondary transfer bias roller formed from, for example, a conductive elastic roller at a secondary transfer nip part formed between the intermediate transfer element and the secondary transfer device. The superimposed color toner image on the intermediate transfer element is transferred onto the transfer material by press-contacting the transfer material against the intermediate transfer element by the secondary transfer bias roller and by applying a secondary transfer bias to the secondary transfer bias roller.

Recently, in a monochromatic image, there are increasing demands for a high quality image in which fine thin lines are reproduced. In a color toner image formed by superimposing a plurality of color toner images on each other, there are also increasing demands for a high quality image that can reproduce further fine thin lines and a sharp image. To fulfill the demands, it has been proposed to use a developer including toner particles of small diameter. When using toner particles of small diameter, the particle diameter of magnetic carrier in a developer also needs to be small so as to charge the toner particle properly. However, as the particle diameter of magnetic carrier becomes smaller, a magnetic attraction force of the magnetic carrier per piece decreases. As a result, the magnetic carrier tends to attach to a photoreceptor by a bias applied between the photoreceptor and a developing device.

Especially, in the case of using a belt-shaped intermediate transfer element, magnetic carrier attached onto a halftone toner image portion having an intermediate image density tends to cause a so-called "white spot" when a toner image is transferred from an intermediate transfer element onto a transfer material (i.e., a secondary transfer). The "white spot" means a condition in which a toner image is partially omitted at around magnetic carrier on a transferred toner image on a transfer material.

There are increasing demands for forming full-color toner images on various kinds of transfer materials, e.g., thin and soft Japanese paper, a transfer material having concave/convex portions. When using such a transfer material having an uneven surface, a space is likely to be formed between a toner image and the transfer material at the time of transfer, thereby making occurrence of white spot conspicuous.

SUMMARY OF THE INVENTION

According to one aspect of the present invention, an image forming apparatus includes at least one latent image carrier configured to carry an electrostatic latent image, at least one developing device configured to develop the electrostatic latent image with developer to form a toner image on the at least one latent image carrier and an intermediate transfer element including an elastic layer and configured to carry the toner image transferred from the at least one latent image carrier. The image forming apparatus further includes a primary transfer device configured to transfer the toner image on the at least one latent image carrier onto the intermediate transfer element and a secondary transfer device configured to transfer the toner image carried by the intermediate transfer element onto a transfer material. The developer includes toner and magnetic carrier, and a weight average particle diameter of the magnetic carrier is in a range of 10 $\mu$m to 80 $\mu$m.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
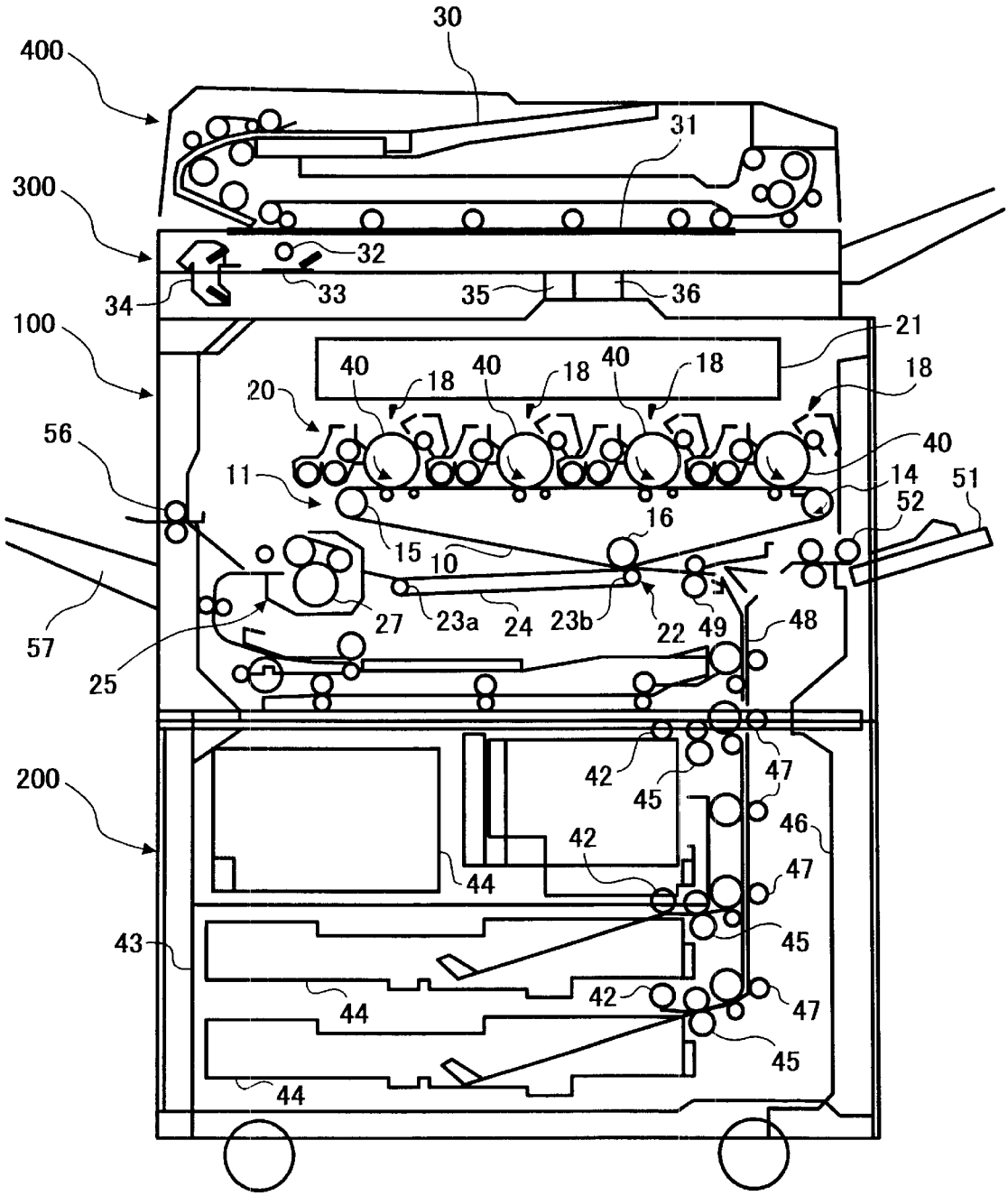
FIG. 1 is a schematic view of a construction of an image forming apparatus according to an embodiment of the present invention.

Preferred embodiments of the present invention are described in detail referring to the drawings, wherein like reference numerals designate identical or corresponding parts throughout the several views. In the embodiments, the present invention is applied to a tandem type image forming apparatus.

FIG. 1 is a schematic view of a construction of an image forming apparatus according to the embodiment of the present invention. An image forming apparatus includes a scanner section 300, an image forming section 100, a sheet feeding section 200, and an auto document feeder (ADF) 400 attached onto the scanner section 300. The image forming apparatus further includes a control device (not shown) that controls operations of each device in an image forming device 20.

The scanner section 300 includes a contact glass 31, a first carriage 33 carrying a light source 32 and a mirror used for reading an image of an original document, a second carriage 34 carrying mirrors, an imaging lens 35 in which the light reflected from an original document is formed into images, and an image reading sensor 36 including a charge-coupled device (CCD) used for reading the image information of the original document.

The image forming section 100 includes an exposure device 21 having laser diodes (LD), a f/θ lens, a polygonal mirror, mirrors, etc., image forming units 18 including charging devices and developing devices functioning to form toner images of four colors: black (BK), yellow (Y), magenta (M), cyan (C), a primary transfer device 11 having a belt-shaped intermediate transfer element 10 rotatably supported at a position opposite to the image forming unit 18, a secondary transfer device 22 that transfers a toner image carried by the intermediate transfer element 10 onto a transfer material P, a pair of registration rollers 49 that feed a transfer material P, which is conveyed from the sheet feeding section 200, to a secondary transfer nip part formed between the intermediate transfer element 10 and the secondary transfer device 22, and a fixing device 25 that fixes the toner image onto the transfer material P.

The sheet feeding section 200 includes a plurality of sheet feeding units 44 having pick-up rollers 42, separation rollers 45, etc., and sheet conveying rollers 47 that convey the transfer material P from the sheet feeding section 200 to the image forming section 100.

Hereinafter, description will be made of the image forming section 100.

Figure 2:
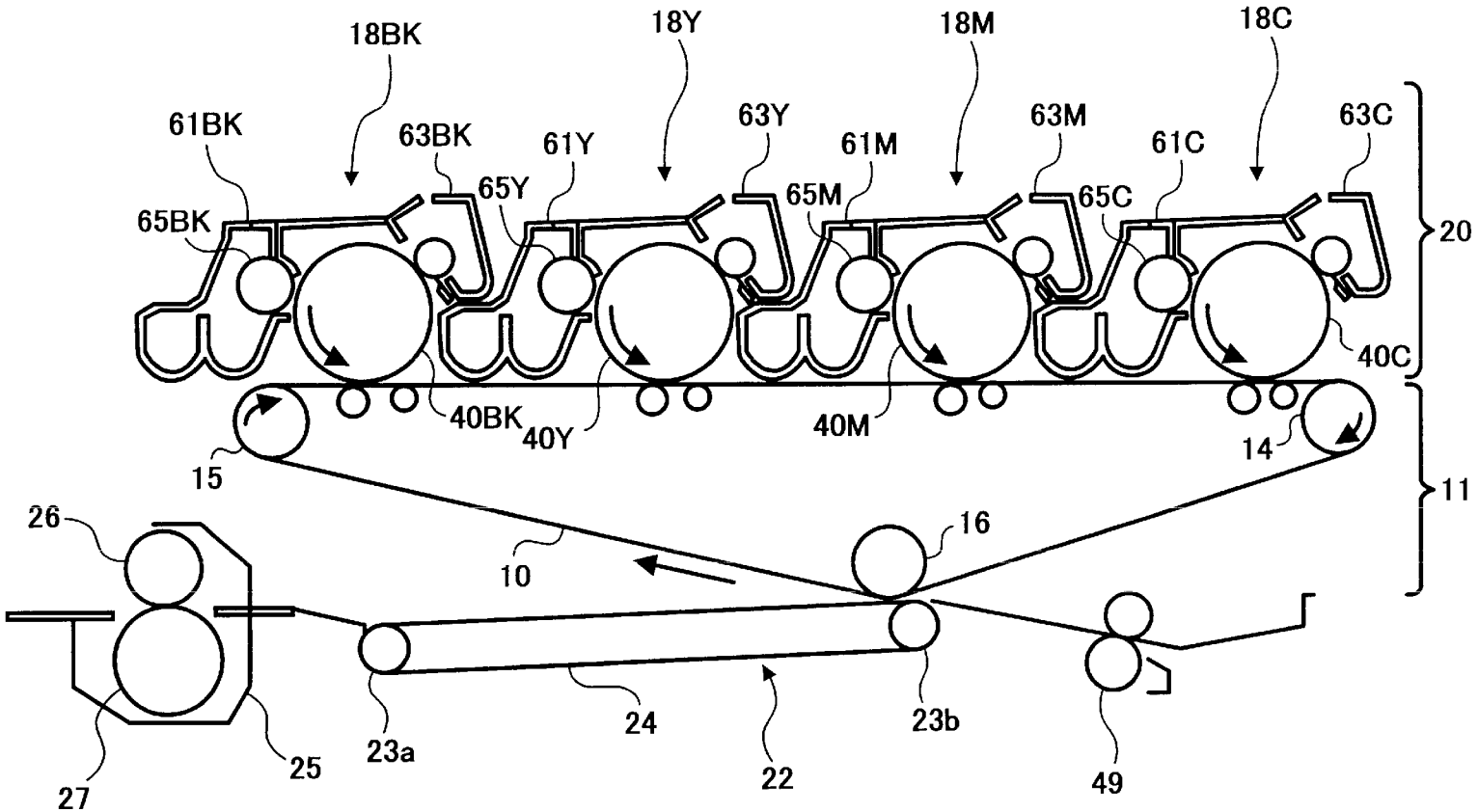
FIG. 2 is a schematic enlarged view of a main portion of an image forming section in the image forming apparatus of FIG. 1.

FIG. 2 is a schematic enlarged view of a main portion of the image forming section 100 in the image forming apparatus. The image forming section 100 includes the intermediate transfer element 10 spanned around three support rollers 14, 15, 16; four photoreceptors 40BK, 40Y, 40M, 40C serving as latent image carriers that carry electrostatic latent images to be respectively formed into a black (BK) toner image, a yellow (Y) toner image, a magenta (M) toner image, a cyan (C) toner image; developing devices 61BK, 61Y, 61M, 61C that develop the electrostatic latent images on the photoreceptors 40BK, 40Y, 40M, 40C with color toner to form toner images of respective colors; and photoreceptor cleaning devices 63BK, 63Y, 63M, 63C that remove residual toner remaining on the surfaces of the photoreceptors 40BK, 40Y, 40M, 40C after the primary transfer (i.e., transfer from the photoreceptors 40BK, 40Y, 40M, 40C to the intermediate transfer element 10). The above-described photoreceptors 40BK, 40Y, 40M, 40C, the developing devices 61BK, 61Y, 61M, 61C, the photoreceptor cleaning devices 63BK, 63Y, 63M, 63C, and other devices are integrally accommodated in image forming units 18BK, 18Y, 18M, 18C, respectively. The image forming units 18BK, 18Y, 18M, 18C construct the tandem type image forming device 20. Hereinafter, the photoreceptors 40BK, 40Y, 40M, 40C may be referred to as a photoreceptor 40 as a whole, and the developing devices 61BK, 61Y, 61M, 61C maybe referred to as a developing device 61.

Figure 3:
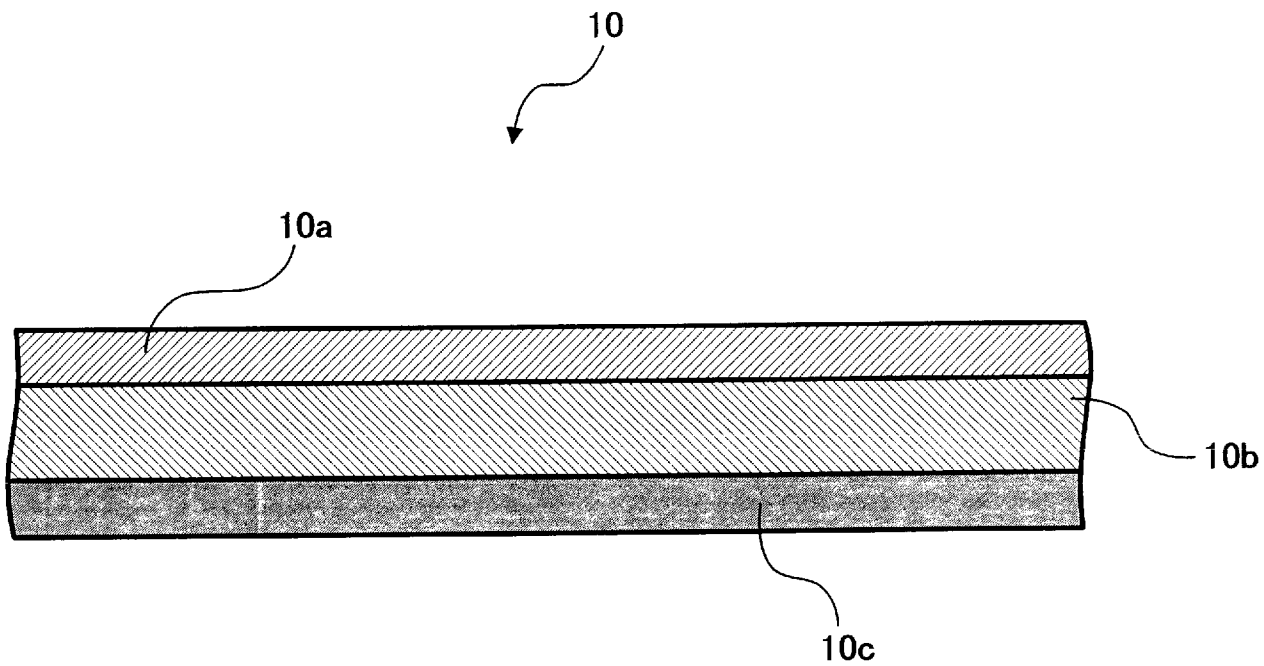
FIG. 3 is a vertical cross section of an exemplary intermediate transfer element employed in the image forming apparatus of FIG. 1.

Next, the details of the intermediate transfer element 10 in the image forming section 100 will be described. FIG. 3 is a vertical cross section of the exemplary intermediate transfer element 10 employed in the image forming apparatus. The intermediate transfer element 10 has a three-layer structure including a base layer 10*a*, an elastic layer lob, and a surface layer 10*c*.

The elastic layer 10*b* of the intermediate transfer element 10 has a low hardness so as to be deformed relative to a toner layer and a transfer material P having an uneven surface at the primary and secondary transfer nip parts. Because the surface of the intermediate transfer element 10 can flexibly deform following concave/convex portions of a toner layer and a transfer material P, the intermediate transfer element 10 can be properly brought into intimate contact with the toner layer without applying excessive transfer pressure to the toner layer, thereby preventing occurrence of a transfer blank image (i.e., some portions of an image are not transferred) at the time of primary and secondary transfers. Further, a transferred toner image having superior uniformity can be obtained on a transfer material P even though the transfer material P has an uneven surface.

As a material for the elastic layer 10*b*, elastic members, such as elastic rubber and elastomer are employed. Specific examples of the elastic members include butyl rubber, fluororubber, acrylic rubber, EPDM, nitrile-butadiene rubber (NBR), acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, silicone rubber, fluororubber, polysulfide rubber, polynorbornene rubber, hydrogenateded nitrile rubber, thermoplastic elastomer (e.g., polystyrene, polyolefin, polyvinyl chloride, polyurethane, polyamide, polyurea, polyester, and fluororesin), but are not limited thereto. These elastic members may be used alone or in combination.

Figure 4A:
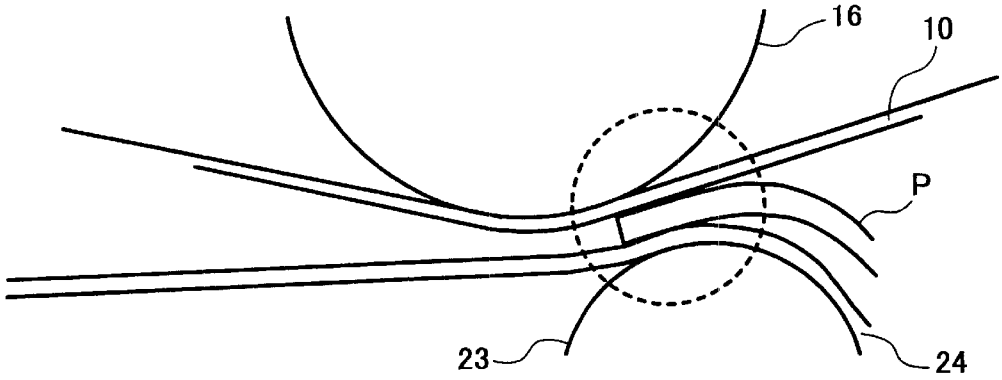
FIG. 4A is a schematic view of a secondary transfer nip part in the image forming apparatus.
Figure 4B:
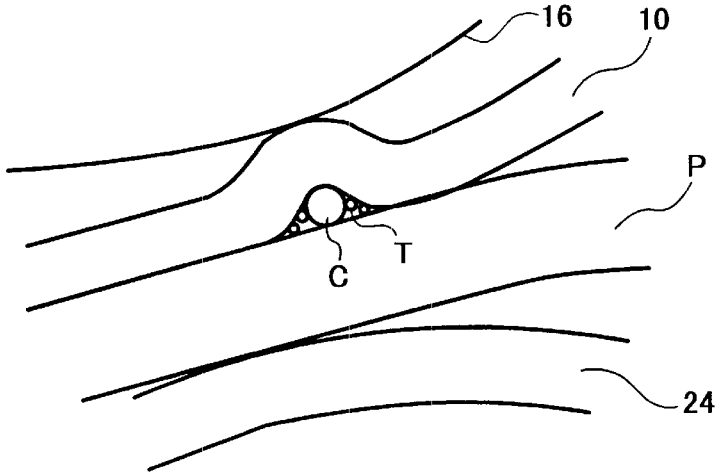
FIG. 4B is a schematic view for explaining a transfer condition at the secondary transfer nip part when using an intermediate transfer element having an adequate thickness.
Figure 4C:
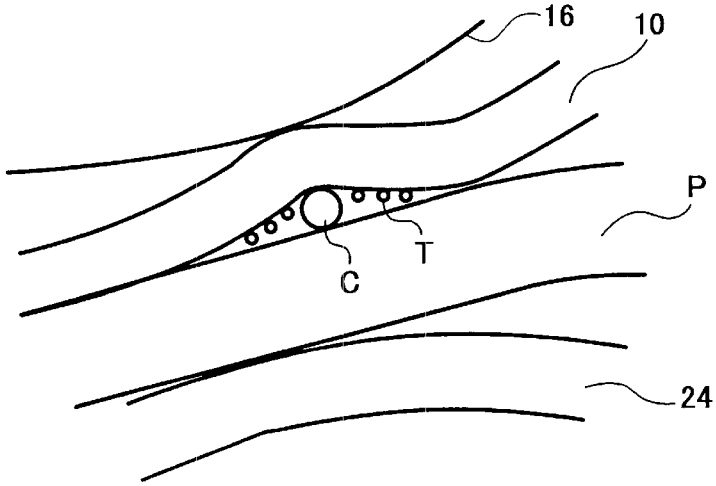
FIG. 4C is a schematic view for explaining a transfer condition at the secondary transfer nip part when using an intermediate transfer element having a small thickness.

Although it depends on hardness and a layer structure, the thickness of the elastic layer 10*b* is preferably in a range of 0.05 mm to 0.3 mm. FIGS. 4A through 4C are schematic views for explaining transfer conditions at the secondary transfer nip part in the image forming apparatus according to the present embodiment. FIG. 4A is a schematic view of the secondary transfer nip part, FIG. 4B is a schematic view of the secondary transfer nip part when using an intermediate transfer element 10 having an adequate thickness, and FIG. 4C is a schematic view of the secondary transfer nip part when using an intermediate transfer element 10 having a small thickness.

If the intermediate transfer element 10 has a thickness of 0.3 mm or greater, a cleaning blade 17*a* of a cleaning device 17, which removes residual toner remaining on the intermediate transfer element 10 after a toner image is transferred from the intermediate transfer element 10 onto a transfer material P, intrudes into the intermediate transfer element 10, thereby interfering with a smooth rotation of the intermediate transfer element 10. In addition, the intermediate transfer element 10 may be dented due to the pressing force of the cleaning blade 17*a*.

If the intermediate transfer element 10 has a thickness of 0.05 mm or less, because the intermediate transfer element 10 does not elastically deform so much that if magnetic carrier exists between the intermediate transfer element 10 and a transfer material P, a space between the intermediate transfer element 10 and the transfer material P is increased by the magnetic carrier, as illustrated in FIG. 4C. As a result, white spots tend to occur on the transfer material P. FIG. 4B illustrates an adequate transfer condition at the secondary transfer nip part.

Preferably, the elastic layer 10*b* has a hardness in a range of 10 degrees to 650 degrees in JIS-A of Japanese Industrial Standards. Although the preferable hardness of the elastic layer 10*b* depends on a layer thickness of the intermediate transfer element 10, if the hardness of the elastic layer 10*b* is less than 10 degrees (JIS-A), it may be difficult to form the intermediate transfer element 10 with accuracy. If the hardness of the elastic layer 10*b* is greater than 650 degrees (JIS-A), it may be difficult to span the intermediate transfer element 10 around the support rollers 14, 15, 16 and to prevent occurrence of white spots.

The base layer 10*a* is formed from, for example, fluororesins providing small elongation, or a mixture of a rubber material providing large elongation and canvas providing small elongation. Specific examples of the material for the base layer 10*a* include polycarbonate, fluororesins (e.g., ETFE, PVDF, etc.), and styrene resins (homopolymers or copolymers containing styrene or substituted styrene) such as polystyrene, chloro polystyrene, poly-α-methylstyrene, styrene-butadiene copolymers, styrene-vinyl chloride copolymers, styrene-vinyl acetate copolymers, styrene-maleic acid copolymers, styrene-acryl ester copolymers (styrene-methyl acrylate copolymers, styrene-ethyl acrylate copolymers, styrene-butyl acrylate copolymers, styrene-octyl acrylate copolymers, styrene-phenyl acrylate copolymers, etc.), styrene-methacrylate ester copolymers (styrene-methyl methacrylate copolymers, styrene-ethyl methacrylate copolymers, styrene-phenyl methacrylate copolymers, etc.), styrene-α-methyl chloroacrylate copolymers, styrene-acrylonitrile-acryl ester copolymers, etc., and methyl methacrylate resins, butyl methacrylate resins, ethyl acrylate resins, butyl acrylate resins, modified acrylic resins (silicone modified acrylic resins, vinyl chloride resin modified acrylic resins, acrylic/urethane resins, etc.), vinyl chloride resins, vinyl chloride vinyl acetate copolymers, rosin modified maleic resins, phenol resins, epoxy resins, polyester resins, polyester polyurethane resins, polyethylene, polypropylene, polybutadiene, polyvinylidene chloride, ionomer resins, polyurethane resins, silicone resins, ketone resins, ethylene-ethylacrylate copolymers, xylene resins and polyvinyl butyral resins, polyamide resins, modified polyphenylene oxide resins. The above-described materials are not limited thereto, and may be used alone or in combination.

Alternatively, the base layer 10*a* may include a core layer formed from a mixture of a rubber material providing large elongation and a material such as canvas which prevents the layer from elongating. In addition, the elastic layer 10*b* may be formed on the base layer 10*a*.

Examples of the material for the core layer which prevents the core layer from elongating include natural fibers such as cotton and silk; synthetic fibers, such as polyester fiber, nylon fiber, acrylic fiber, polyolefin fiber, polyvinyl alcohol fiber, polyvinyl chloride fiber, polyvinylidene chloride fiber, polyurethane fiber, polyacetal fiber, poly fluoro ethylene fiber, and phenolic fiber; inorganic fiber, such as carbon fiber, glass fiber, and boron fiber; and metal fiber such as iron fiber and copper fiber, but are not limited thereto. These materials may be used alone or in combination, and may be formed in a shape of string or woven fabric.

The string-shaped fiber materials may be formed by various twisting methods such as twisting single or multiple filaments. The string-shaped fiber material may be single twist yarn, ply yarn, two ply yarn, etc. Further, the string-shaped fiber materials may be subjected to appropriate conductive processing.

The woven fabric-shaped fiber materials may be formed by various weaving methods such as knitting and combined weaving. The woven fabric-shaped fiber materials may be also subjected to appropriate conductive processing.

The surface layer 10*c* has smoothness and serves to coat the surface of the elastic layer 10*b* with fluororesin, for example. As a material for the surface layer 10*c*, a material which increases the secondary transfer efficiency by decreasing adhesion force of toner to the surface of the intermediate transfer element 10, is generally used. Thus, it is preferable that the surface tension of the surface layer 10*c* is in a range of 100 $\mu$N/cm (10 dyn/cm) to 400 $\mu$N/cm (40 dyn/cm). If the surface tension of the surface layer 10*c* is less than 100 $\mu$N/cm (10 dyn/cm), the adhesion force of magnetic carrier to the intermediate transfer element 10 decreases, thereby causing the magnetic carrier to adhere onto the transfer material P. As a result, white spots occur. If the surface tension of the surface layer 10*c* exceeds 400 $\mu$N/cm (40 dyn/cm), the adhesion force of toner to the intermediate transfer element 10 increases, thereby decreasing the secondary transfer efficiency. As a result, an image quality is deteriorated.

The surface layer 10*c* may be made of fluororesins, silicone resins, polyurethane, polyester resins, epoxy resins, etc. These materials may be used alone or in combination. To decrease the surface energy and to raise the lubricity of the surface layer 10*c*, a material in which one kind or two or more kinds of particles of fluororesins, fluorine compound, fluorocarbon, titanium oxide, silicon carbide, etc., are dispersed, may be used for the surface layer 10*c*. When using fluororesins and silicone resins as the materials for the surface layer 10*c*, the surface tension of the surface layer 10*c* may be decreased by performing heat treatment.

The surface electrical resistivity of the surface layer 10*c* is preferably in a range of $1\times10^{9}$ Ω/□ to $1\times10^{16}$ Ω/□. If the surface electrical resistivity of the surface layer 10*c* is less than $1\times10^{9}$ Ω/□, the attenuation of the charge of magnetic carrier and toner increases, and transfer efficiency decreases. If the surface electrical resistivity of the surface layer 10*c* exceeds $1\times10^{16}$ Ω/□, white spots and adhesion of carrier occur due to the abnormal discharge between the intermediate transfer element 10 and magnetic carrier.

For example, to adjust the resistance of the elastic layer 10*b*, the surface layer 10*c*, and the base layer 10*a*, metal powder, such as carbon black, graphite, aluminum, and nickel, and electroconductive metal oxides, such as tin oxide, titanium oxide, antimony oxide, indium oxide, potassium titanate, antimony oxide-tin oxide complex oxide (ATO), and indium oxide-tin oxide complex oxide (ITO) may be used. The electroconductive metal oxides may be coated with insulative fine particles, such as barium sulfate, magnesium silicate, and calcium carbonate.

Figure 5:
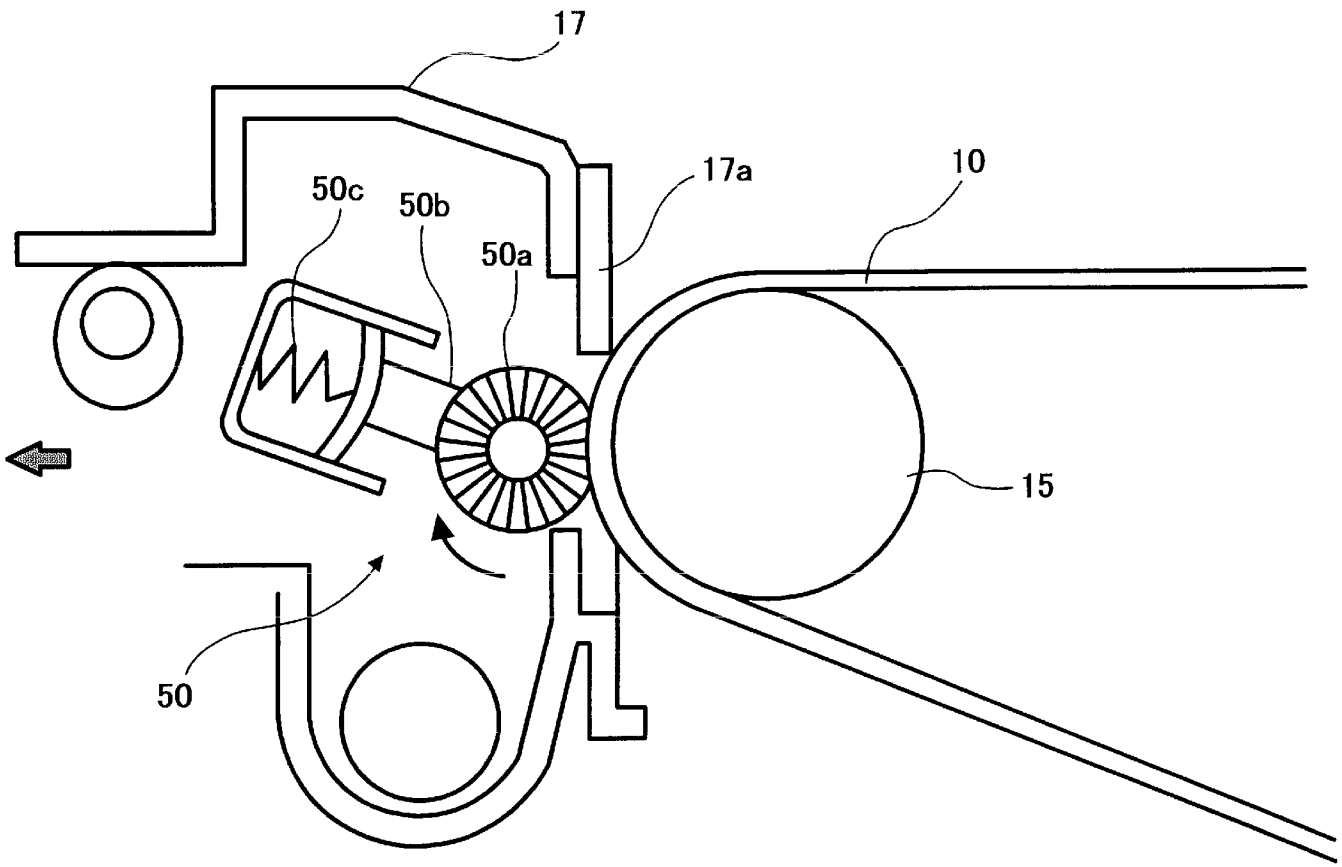
FIG. 5 is a schematic view of a cleaning device and a lubricant applying device in the image forming apparatus according to the embodiment of the present invention.

As illustrated in FIG. 5, the image forming apparatus according to the present embodiment includes the cleaning device 17 at the left side of the support roller 15 to remove residual toner remaining on the intermediate transfer element 10 after a toner image is transferred from the intermediate transfer element 10 onto a transfer material P. The cleaning device 17 includes the cleaning blade 17*a* serving as a cleaning member formed from elastic rubber. As a material for the elastic rubber, it is preferable to use urethane resins and isoprene rubber.

The cleaning blade 17*a* may contact the intermediate transfer element 10 in a counter direction or trailing direction with respect to the rotating direction of the intermediate transfer element 10. It is preferable that the cleaning blade 17*a* contacts the intermediate transfer element 10 at a position where the intermediate transfer element 10 is wound around the support roller. At such a contact position, the intermediate transfer element 10 is prevented from being deformed even though the cleaning blade 17*a* is press-contacted against the intermediate transfer element 10. The residual toner removed by the cleaning blade 17*a* is conveyed to a container (not shown).

The image forming apparatus according to the present embodiment further includes a lubricant applying device 50 that applies a lubricant to the intermediate transfer element 10. As illustrated in FIG. 5, the lubricant applying device 50 includes a solid lubricant 50*b*, a brush 50*a* that applies the lubricant 50*b* to the intermediate transfer element 10, a spring 50*c* that biases the lubricant 50*b* toward the brush 50*a* so as to make the lubricant 50*b* abut the brush 50*a* with a predetermined pressing force, and a cover that supports the spring 50*c*. When the brush 50*a* is rotated, the lubricant 50*b* biased by the spring 50*c* is scraped off by the brush 50*a* and adheres onto the surface of the brush 50*a*. While the brush 50*a* is rotated in contact with the intermediate transfer element 10, the lubricant 50*b* adhered onto the brush 50*a* is applied onto the surface of the intermediate transfer element 10.

Various materials having lubricating properties may be used for the lubricant 50*b*. Examples of materials for the lubricant 50*b* include various fluorine-containing resins such as PTFE and PVDF; silicone resins; polyolefin resins; paraffin waxes; fatty acid metal salts such as, stearic acid, lauric acid, and palmitic acid; lubricity solids such as graphite and molybdenum disulfide. As the fatty acid metal salts, stearic acid metal salts is preferably used. Further, as resin fine powder, fluororesins is preferably used. The stearic acid metal salts are chemical compounds made up of stearic acid and zinc, aluminum, barium, magnesium, or iron.

These chemical compounds have cleavage properties. When such chemical compounds receive pressure, the chemical compounds cleave and change into thin film shapes. For example, a thin film is formed on the surface of the intermediate transfer element 10 to which these chemical compounds are applied, thereby decreasing the adhesion force of toner to the surface of the intermediate transfer element 10. Especially, zinc stearate having a high cleavage property is preferable.

Because the lubricant 50*b* is applied onto the surface of the intermediate transfer element 10 before a toner image is transferred onto the intermediate transfer element 10 from the photoreceptor, the adhesion force of toner to the intermediate transfer element 10 decreases, thereby increasing the image transfer efficiency. As a result, the occurrence of defective images is obviated.

Next, a description will be made of the secondary transfer device 22 in the image forming section 100 (see FIG. 1)

In the secondary transfer device 22, a secondary transfer belt 24 is spanned around rollers 23*a* and 23*b*. The secondary transfer belt 24 is pressed against the support roller 16 via the intermediate transfer element 10, thereby forming the secondary transfer nip part in which a toner image is transferred from the intermediate transfer element 10 onto a transfer material P fed from the registration rollers 49 at an appropriate timing such that the positions of the transfer material P and the toner image on the intermediate transfer element 10 correctly meet with each other. After the toner image on the intermediate transfer element 10 is transferred onto the transfer material P, the residual toner remaining on the intermediate transfer element 10 is removed by the cleaning device 17.

The line pressure applied to the intermediate transfer element 10 from the support roller 16 is preferably in a range of 20 g/cm to 110 g/cm. If the line pressure is less than 20 g/cm, the length of the secondary nip part is relatively short, so that the intermediate transfer element 10 does not contact a transfer material P tightly, thereby decreasing the image transfer efficiency. If the line pressure exceeds 110 g/cm, the length of the secondary nip part is relatively long, thereby increasing the image transfer efficiency. However, magnetic carrier tends to adhere onto the intermediate transfer element 10, resulting in occurrence of white spots.

Figure 6:
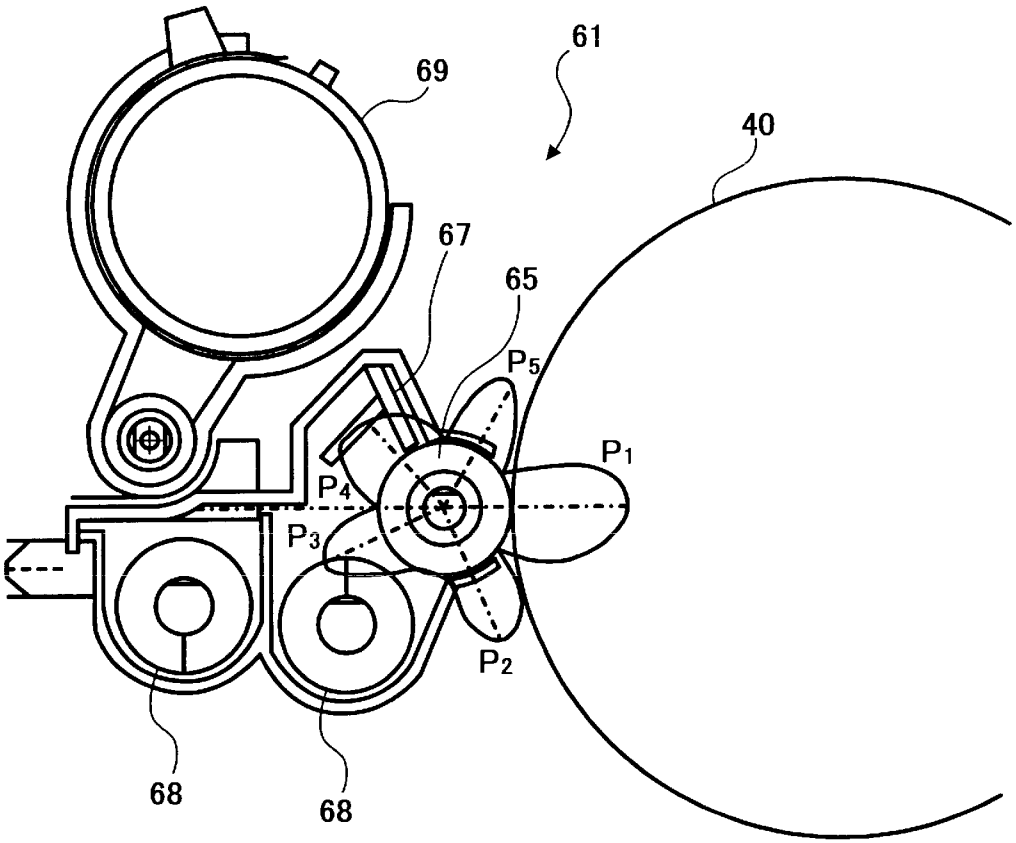
FIG. 6 is a schematic view of a developing device in the image forming apparatus according to the embodiment of the present invention.

Hereinafter, description will be made of the developing device 61 in the image forming section 100. FIG. 6 is a schematic view of the developing device 61 in the image forming apparatus according to the present embodiment. The developing device 61 uses a two-component developer including toner and magnetic carrier. The developing device 61 includes a developer cartridge 69 that accommodates a two-component developer, an agitating section that conveys and supplies the two-component developer from the developer cartridge 69 to a developing sleeve 65 while agitating the two-component developer, and a developing section that transfers toner of the two-component developer adhered onto the developing sleeve 65 to the photoreceptor 40. The agitating section is arranged at a lower position than the developing section. In the agitating section, two screws 68 are provided in parallel to each other. A partition plate is provided between the two screws 68 such that communicating openings are formed at both end sides of the partition plate so as to convey the two-component developer through the communicating openings.

The developing sleeve 65 opposes the photoreceptor 40 through an opening of a case (not shown). The developing section in the developing device 61 further includes a doctor blade 67 that regulates an amount of the developer being carried and conveyed by the developing sleeve 65. The developing sleeve 65 includes a non-magnetic sleeve-shaped member and a plurality of magnets inside thereof. These magnets are fixed and exert magnetic force on the developer when the developer passes a predetermined position. The surface of the developing sleeve 65 is sandblasted such that the ten-point mean surface roughness (Rz) of the developing sleeve 65 is in a range of 10 $\mu$m to 30 $\mu$m. Alternatively, a plurality of grooves having the depths ranged from 1 mm to several millimeters may be formed on the surface of the developing sleeve 65.

The developer forms a magnet brush on the developing sleeve 65 due to the magnetic force of the magnets arranged in the developing sleeve 65. In the developing sleeve 65, a magnetic roller body (not shown) is fixedly provided to generate a magnetic field such that the head of the magnet brush rises on the peripheral surface of the developing sleeve 65. An ear of magnetic carrier of the developer is formed on the developing sleeve 65 along a magnetic line of force in a normal direction that is produced by the magnetic roller body. Charged toner is adhered to the ear of the magnetic carrier, thereby constructing the magnet brush of the developer. The magnet brush is conveyed in the same direction as the rotating direction of the developing sleeve 65.

The magnetic roller body includes a plurality of magnetic poles (magnets): a developing main magnet (P1) that forms an ear of the developer at a developing region where the developing sleeve 65 faces the photoreceptor 40; a magnet (P3) that scoops up the developer onto the developing sleeve 65; magnets (P4) and (P5) that convey the scooped-up developer to the developing region; and a magnet (P2) that conveys the developer after the development is performed in the developing region. The above-described magnets (P1) through (P5) are arranged in the radial direction of the developing sleeve 65.

The main magnet (P1) forming the development main pole is formed from a magnet having a small cross section. As the main magnet (P1), for example, a samarium alloy magnet, specifically, a samarium-cobalt alloy magnet may be employed.

As representative examples of a rare earth metal alloy magnet, an iron neodymium boron alloy magnet has a maximum energy product of 358 kJ/m$^3$, and an iron neodymium boron alloy bond magnet has a maximum energy product of around 80 kJ/m$^3$. By using these magnets, the necessary surface magnetic force of the developing sleeve 65 can be ensured, even if the size of the developing sleeve 65 is considerably reduced. As examples of a magnet used in a background developing device, a ferrite magnet and a ferrite bond magnet have maximum energy products of around 36 kJ/m$^3$ and 20 kJ/m$^3$, respectively.

With regard to the two-component developer used in the developing device 61, magnetic carrier includes magnetic particles such as alloy including transition metal such as Fe, Ni, Co; Heusler alloy for Cu—Mn—Al; Fe oxides such as magnetite, $\gamma$-hematite; CrO2 oxide; and ferrite including divalent metal such as Mn, Cu, Zn, Mg. Further, it is desirable that the surface of the magnetic particle is covered with resins, etc. Examples of the resins include poly fluoridation carbon, acrylic resins, silicone resins, etc.

As a method of forming a resin film on the surface of the magnetic particle, resins may be applied onto the surface of the magnetic particle by an atomizing method, a dipping method, etc. The amount of the resins for covering the surface of the magnetic particle of carrier is preferably 1–10 parts by weight per 100 parts by weight of the carrier particle. A preferable thickness of the resin film is in a range of 0.02 $\mu$m to 2 $\mu$m, and more preferably in a range of 0.05 $\mu$m to 1 $\mu$m. If the thickness of the film is small, the useful lifetime of the developer decreases due to the scrape of the film with time.

Figure 7A:
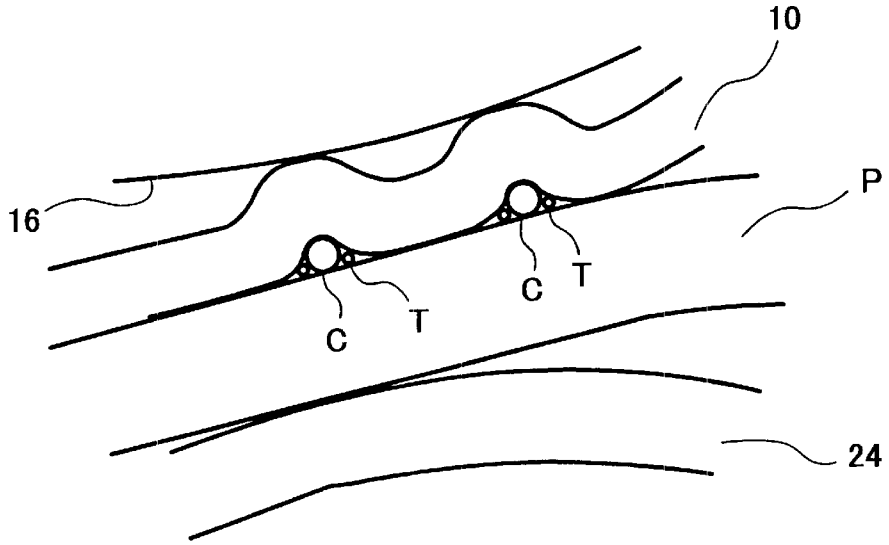
FIG. 7A is a schematic view for explaining a transfer condition at the secondary transfer nip part when the weight average particle diameter of magnetic carrier is relatively small.
Figure 7B:
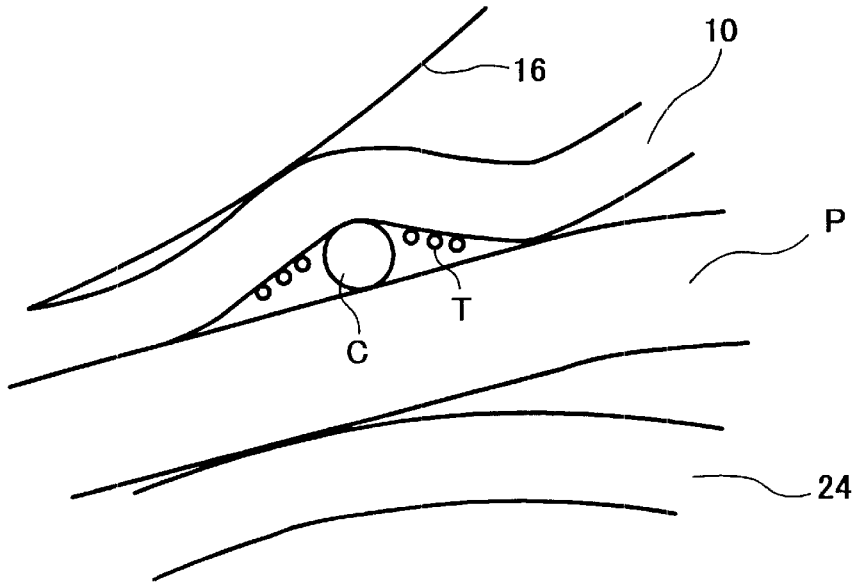
FIG. 7B is a schematic view for explaining a transfer condition at the secondary transfer nip part when the weight average particle diameter of magnetic carrier is relatively great.

The weight average particle diameter of the magnetic carrier is in a range of 10 $\mu$m to 80 $\mu$m, and preferably in a range of 10 $\mu$m to 40 $\mu$m. FIGS. 7A and 7B are schematic views for explaining a transfer condition at the secondary transfer nip part in the image forming apparatus. Specifically, FIG. 7A is a schematic view for explaining a transfer condition when the weight average particle diameter of the magnetic carrier is relatively small, and FIG. 7B is a schematic view for explaining a transfer condition when the weight average particle diameter of the magnetic carrier is relatively great.

Referring to FIG. 7A, when the weight average particle diameter of magnetic carrier is 10 $\mu$m or less, the magnetic carrier tends to adhere onto the photoreceptor 40 due to the decrease of magnetic force of the magnetic carrier. As a result, the magnetic carrier adhered onto the photoreceptor 40 is transferred onto a transfer material P via the intermediate transfer element 10. When the weight average particle diameter of magnetic carrier is 80 $\mu$m or greater, as illustrated in FIG. 7B, a space is formed between the intermediate transfer element 10 and the transfer material P due to the magnetic carrier, thereby causing occurrence of white spots. As a result, an image quality is deteriorated. When the weight average particle diameter of magnetic carrier is greater than 10 $\mu$m and less than 40 $\mu$m, the magnetic carrier does not tend to adhere onto the photoreceptor 40. Further, even if the toner having a small particle diameter is used in the two-component developer, the charging amount of the toner may be easily adjusted. As a result, a high quality image is obtained. The weight average particle diameter of the magnetic carrier is measured by a laser diffraction method.

With regard to the volume resistivity of magnetic carrier, it is preferable that the volume resistivity of the magnetic carrier is in a range of $1\times10^8$ Ω·cm to $1\times10^{15}$ Ω·cm when a direct current voltage of 250V is applied to the magnetic carrier.

If the volume resistivity of the magnetic carrier is low, it is advantageous for the development because the electric field intensity increases in the developing region. However, when the electric field intensity increases and exceeds the limit of discharge as is shown by the Paschen's law, discharge occurs between the magnetic carrier and the photoreceptor 40. As a result, the development is not performed, and the photoreceptor 40 is damaged. Therefore, it is preferable that the volume resistivity of the magnetic carrier is in a range which provides a high development efficiency without causing the discharge. For these reasons, it is not preferred that the volume resistivity of the magnetic carrier is less than $1\times10^8$ Ω·cm when a direct current voltage of 250V is applied to the magnetic carrier, because discharge occurs. If the volume resistivity of the magnetic carrier exceeds $1\times10^{15}$ Ω·cm when a direct current voltage of 250V is applied to the magnetic carrier, the development efficiency decreases.

In the toner employed in this embodiment, additives of inorganic powder dealt with surface modification agent, such as silane coupling agent and titanate coupling agent, are added to the particle including at least binder resin and colorant.

Examples of the binder resins include acrylic resins, polyester resins, epoxy resins, polyol resins, rosin modified maleic resins, phenol resins, low molecular weight polyethylene, low molecular weight polypropylene, ionomer resins, ethylene-ethylacrylate copolymers, polyvinyl butyral, etc. These resins may be used alone or in combination. Especially, polyester resins and acrylic resins are preferable.

As colorant, dye and pigment may be used. Examples of black colorant for BK toner include azine pigments such as carbon black and aniline black; metal salt azo pigment; and metal oxides such as magnetite, etc. Examples of yellow colorant for Y toner include naphthol yellow S, hansa yellow (10G, 5G, G), poly azo yellow, oil yellow, hansa yellow (GR, A, RN, R), pigments yellow L, benzidine yellow (G, GR), permanent yellow (NCG), etc.

Examples of red colorant for M toner include permanent red 4R, lithol fast scarlet G, brilliant fast scarlet, brilliant carmine 3S, permanent red (F2R, F4R), etc. Examples of blue colorant for C toner include copper phthalocyanine blue, cobalt blue, metal-free phthalocyanine blue, fast sky blue, indanthrene blue (RS BC), indigo, anthraquinone blue, fast violet 8, methyl violet rake, etc. The above-described colorant may be used alone or in combination. The containing amount of the colorant is generally 1–30 parts by weight, preferably 3–20 parts by weight, per 100 parts by weight of the binder resin.

If necessary, other materials such as a charge controlling agent and a toner releasing agent may be added to the toner. Examples of the charge controlling agents include Nigrosin dyes, chrome-containing complexes, quaternary ammonium salts, etc., according to the required charge amount and polarity of the toner.

In the case of color toner, colorless or light-colored charge controlling agent which does not affect the color tone of toner is desirable. For example, salicylic acid metal salts or metal salts of salicylic acid derivatives, etc. may be used. These charge controlling agents may be used alone or in combination. The containing amount of the charge controlling agent is generally 0.5–8 parts by weight, preferably 1–5 parts by weight, per 100 parts by weight of the binder resin.

To improve the releasing property of toner from rollers in the fixing device 25 and fixing efficiency of toner when fixing a toner image onto a transfer material P in the fixing device 25, toner may contain a toner releasing agent. Examples of the toner releasing agents include synthesis hydrocarbon waxes such as low molecular weight polyolefin waxes such as low molecular weight polyethylene and low molecular weight polypropylene; beeswaxes; various modified waxes, etc. These toner releasing agents may be used alone or in combination. The containing amount of the toner releasing agent is generally 1–15 parts by weight, preferably 2–10 parts by weight, per 100 parts by weight of the binder resin. If the containing amount of the toner releasing agent is less than 1 part by weight, an offset condition may not be obviated well. If the containing amount of the toner releasing agent is greater than 15 parts by weight, the transfer efficiency and durability of toner may be decreased due to the decrease of fluidity of toner.

The toner density of a developer including a mixture of toner and magnetic carrier is preferably in a range of 0.5% to 15%, and the charge amount of the toner is preferably in a range of 10 $\mu$C/g to 30 $\mu$C/g.

Hereinafter, an operation of the image forming apparatus according to the embodiment of the present invention will be described (see FIG. 1).

First, an original document is set on an original document setting table 30 in the auto document feeder 400 or set on the contact glass 31 in the scanner section 300 by opening the auto document feeder 400 and is then pressed by closing the auto document feeder 400. When pressing a start switch (not shown), the scanner section 300 is driven after the original document is conveyed onto the contact glass 31 when the original document is set on the original document setting table 30 in the auto document feeder 400 or driven immediately when the original document is set on the contact glass 31 in the scanner section 300. Thereby, the first and second carriages 33 and 34 are driven to move. An image surface of an original document is exposed to light emitted from the light source 32 carried on the first carriage 33. The light reflected from the image surface of the original document is further reflected by the mirror on the first carriage 33 toward the mirrors carried on the second carriage 34.

The light reflected from the mirrors on the second carriage 34 corresponding to the image of the original document is imaged on the image reading sensor 36 through the imaging lens 35. The image information of the original document read by the image reading sensor 36 is transmitted to the control device (not shown). The control device controls laser diodes (LD, not shown) or light-emitting diodes (LED, not shown) arranged in the exposure device 21 in the image forming section 100 to irradiate the surfaces of the photoreceptors 40BK, 40Y, 40M, 40C, with laser writing light based on the image information transmitted from the scanner section 300, thereby forming electrostatic latent images on the surfaces of the photoreceptors 40BK, 40Y, 40M, 40C.

In the sheet feeding section 200, transfer materials P are fed out from the sheet feeding cassette 44 by the pick-up roller 42. The separation roller 45 separates a top transfer material P from the rest of the fed-out transfer materials P and feeds the top transfer material P to a sheet conveying path 46. The transfer material P in the sheet conveying path 46 is then conveyed to a sheet conveying path 48 in the image forming section 100 by sheet conveying rollers 47.

As an alternative to the sheet feeding section 200, a transfer material P may be fed to the image forming section 100 from a manual sheet feeding tray 51. In this case, transfer materials P set on the manual sheet feeding tray 51 are fed out by a separation roller 52, which separates a top transfer material P from the rest of the stack of transfer materials P on the manual sheet feeding tray 51, toward the registration rollers 49. The manual sheet feeding tray 51 is provided at a right side surface of the image forming apparatus as illustrated in FIG. 1.

The registration rollers 49 feed the transfer material P conveyed from the sheet feeding cassette 44 or the manual sheet feeding tray 51 to the secondary transfer nip part formed between the intermediate transfer element 10 in the primary transfer device 11 and the secondary transfer device 22.

In the image forming section 100, after receiving the image information from the scanner section 300, electrostatic latent images are formed on the surfaces of the photoreceptors 40BK, 40Y, 40M, 40C by performing the above-described laser writing process. As described earlier, the developer is scooped up onto the developing sleeve 65 and is formed into a magnet brush on the developing sleeve 65 by the magnetic force of the magnet (not shown). The magnet brush develops the electrostatic latent images formed on the photoreceptors 40BK, 40Y, 40M, 40C by applying a development bias voltage, in which an alternating current voltage and a direct current voltage are superimposed, to the developing sleeve 65. Thereby, toner images of respective colors are formed on the surfaces of the photoreceptors 40BK, 40Y, 40M, 40C.

Next, to feed the transfer material P of a selected size, one of the pick-up rollers 42 is operated. Correspondingly, the intermediate transfer element 10 is rotated by driving one of the support rollers 14, 15, 16 to rotate. Substantially simultaneously, a black toner image, a yellow toner image, a magenta toner image, and a cyan toner image are formed on the surfaces of the photoreceptors 40BK, 40Y, 40M, 40C, respectively, while rotating the photoreceptors 40BK, 40Y, 40M, 40C in each of the image forming units 18. The black, yellow, magenta, and cyan toner images on the photoreceptors 40BK, 40Y, 40M, 40C are sequentially transferred onto the intermediate transfer element 10 so that the black, yellow, magenta, and cyan toner images are superimposed on the same surface of the intermediate transfer element 10 with each other in alignment. Thereby, a superimposed color toner image is formed on the intermediate transfer element 10.

On the other hand, a transfer sheet P conveyed from the sheet feeding cassette 44 in the sheet feeding section 200 or from the manual sheet feeding cassette 51 is abutted against the registration rollers 49. The registration rollers 49 feed the transfer material P toward the secondary transfer nip part formed between the intermediate transfer element 10 and the secondary transfer roller 23*b* such that the leading edge of the transfer material P is aligned with the leading edge of the superimposed color toner image formed on the intermediate transfer element 10. The color toner image on the intermediate transfer element 10 is transferred onto the transfer material P at the secondary transfer nip part under the influence of a secondary transfer electric field and a contact pressure while applying a secondary transfer bias to the secondary transfer roller 23*b*. Preferably, a direct current voltage is used as the secondary transfer bias.

The transfer material P having a color toner image is conveyed to a nip part between a heat roller 26 and a pressure roller 27 in the fixing device 25 by the rotation of the sheet conveying belt 24 in the secondary transfer device 22. The color toner image is fixed onto the transfer material P by heat and pressure after passing through the nip part between the heat roller 26 and the pressure roller 27. The transfer material P having a fixed color toner image is discharged onto a sheet discharging tray 57 by a pair of sheet discharging rollers 56.

Figure 8:
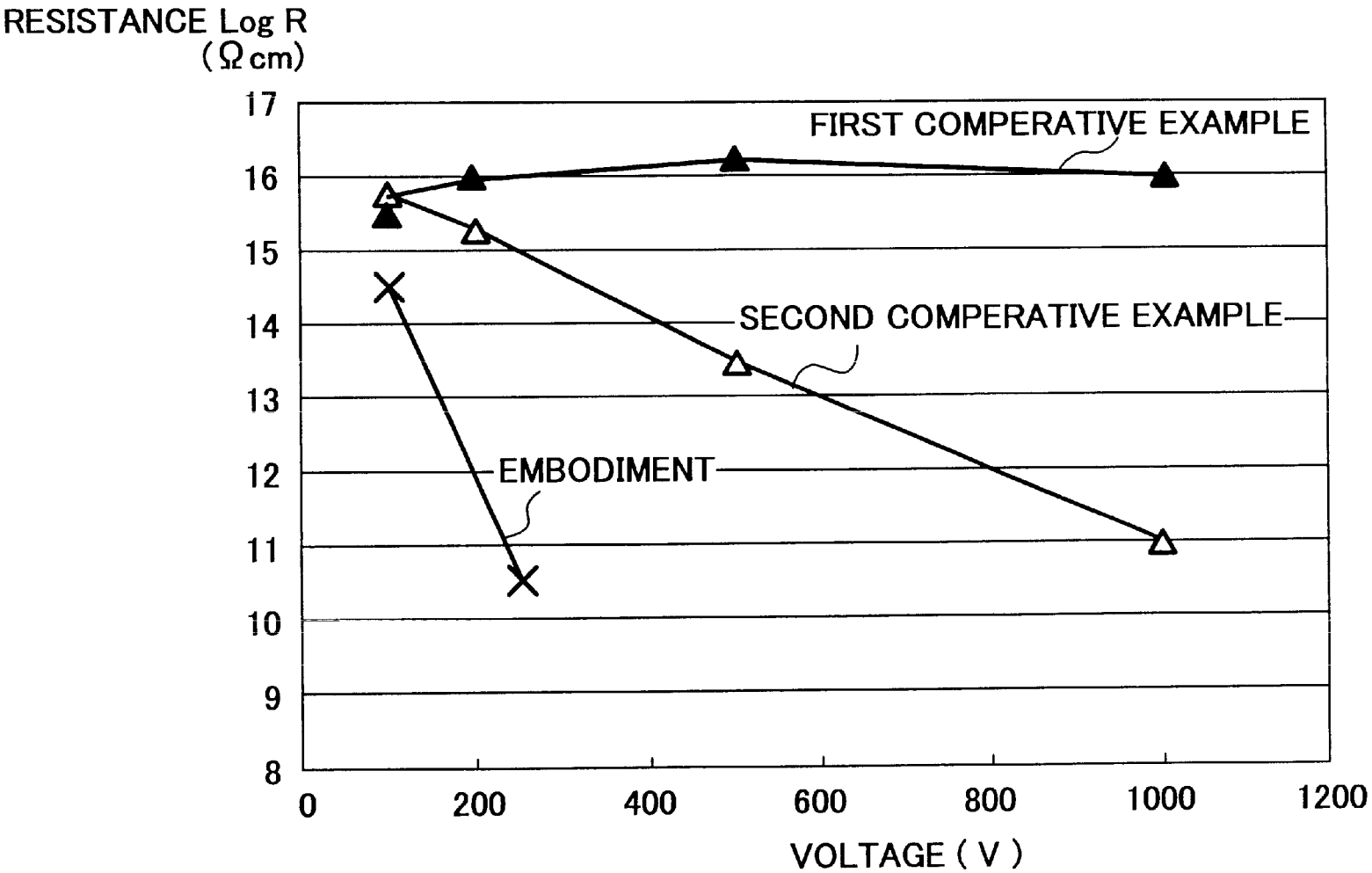
FIG. 8 is a graph showing a measurement result of a volume resistivity of magnetic carrier according to the embodiment and first and second comparative examples.

The present inventors have measured the volume resistivity of magnetic carrier, and formed a toner image on a transfer material P in the image forming device 20 using the measured magnetic carrier. Subsequently, the number of magnetic carrier on the toner image formed on the transfer material P discharged onto the sheet discharging tray 57 was measured. The measurement result of the volume resistivity of the magnetic carrier is shown in Table 1 and FIG. 8.

The volume resistivity of the magnetic carrier is measured by the following method: hollowing out resin cylindrically; putting magnetic carrier into the hollow of the resin; pinching the magnetic carrier by parallel electrodes; and applying a desired voltage to the electrodes.

Table 1 shows the measurement result of the volume resistivity of the magnetic carrier when applying 250V to the magnetic carrier.

TABLE 1

| | Volume resistivity (Ω · cm) |
|---|---|
| Embodiment | $3 \times 10^{10}$ |
| First comparative example | $1 \times 10^{16}$ |
| Second comparative example | $2 \times 10^{15}$ |

The conditions of the image forming process of the image forming device 20 are described as follows:

| | | | |
|---|---|---|---|
| (Photoreceptor) | | | |
| Image portion potential: | | −150 | V |
| Non-image portion potential: | | −700 | V |
| Linear velocity of photoreceptor: | | 245 | mm/s |
| (Developing device) | | | |
| Developing sleeve: | Diameter: | 25 | mm |
| | Liner velocity: | 372 | mm/s |
| Magnetic flux density: | | 90 | mT |
| Distance between photoreceptor and developing sleeve: | | 0.40 | mm |
| Distance between doctor blade and developing sleeve: | | 0.87 | mm |
| (Development electric field) | | | |
| Development bias: | AC bias: | 4.5 | kHz, |
| | Vp-p: | 800 | V |
| | DC bias: | −450 | V |

-continued

| | | |
|---|---|---|
| (Developer) | | |
| Magnetic carrier: | | |
| Magnetic substance: Cu-Zn ferrite | | 100 parts by weight |
| Resin layer: Silicone resin | | 5 parts by weight |
| Weight average particle diameter: | | 35 $\mu$m |
| Toner (BK): | | |
| Binder resin: styrene-acryllic resin | | 100 parts by weight |
| Pigment: carbon black | | 10 parts by weight |
| External additives: Silica | | 0.5 parts by weight per 100 parts by weight of toner |
| Developer: | Toner density: | 5% |
| | Toner charge amount: | 20–35 $\mu$C/g |
| | (Intermediate transfer element) | |
| Layer structure: | Three layer structure | |
| Elastic layer: | Material: fluorine rubber (PVDF) | |
| | Thickness: | 0.15 mm |
| | Hardness: | 60 degrees |
| Surface layer: | Material: fluorine resin (PTFE), carbon black | |
| | Surface resistivity: | $1 \times 10^{13}$ Ω/□ |
| | (Secondary transfer electric field) | |
| DC bias: | | −1.5 to 2.0 kV |
| Transfer pressure: | | 85–171 g/cm |

Figure 9:
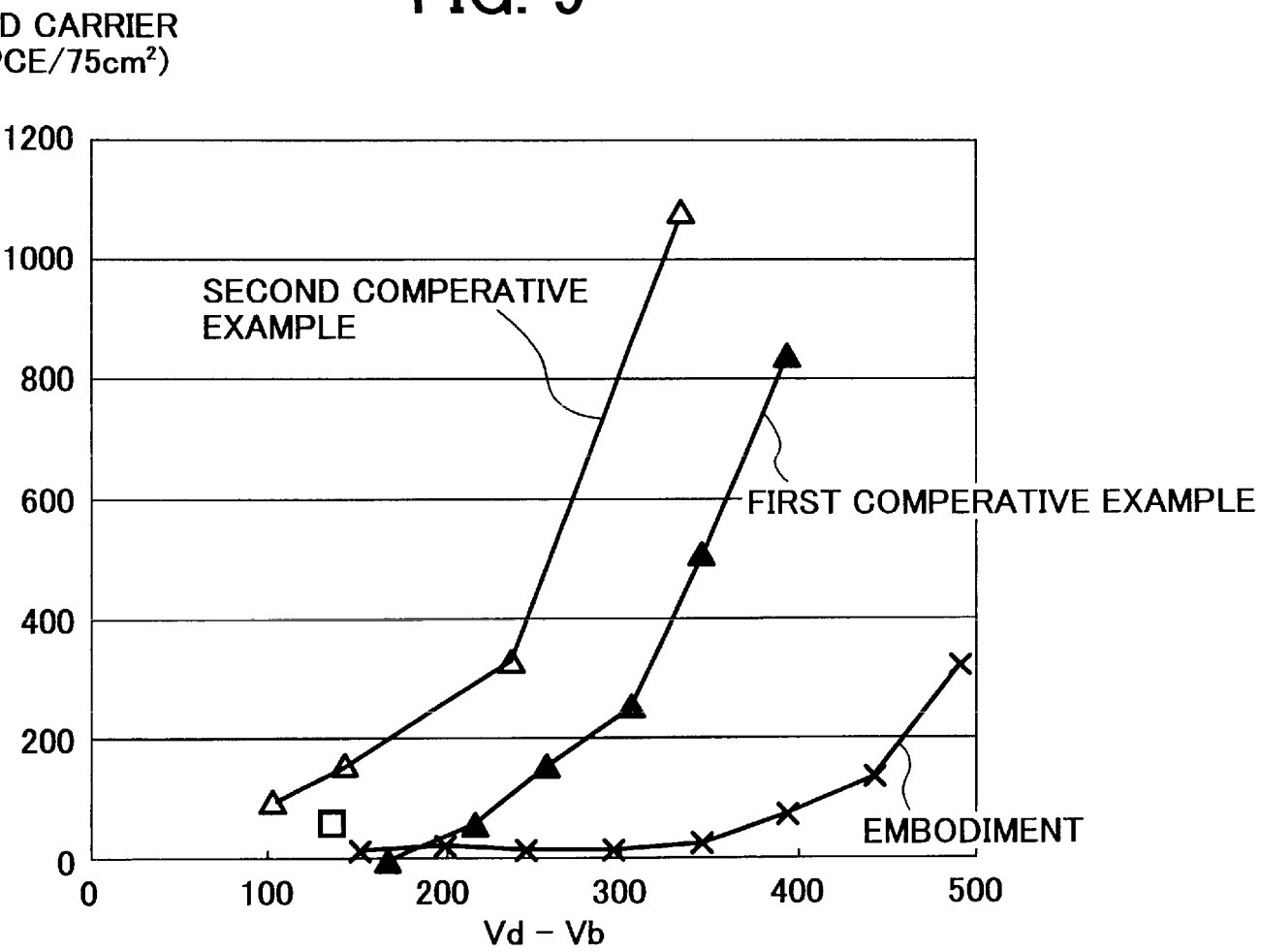
FIG. 9 is a graph showing a measurement result of number of adhered carrier according to the embodiment and the first and second comparative examples.

The present inventors measured the adhering of carrier under the above-described conditions using the magnetic carrier having respective volume resistivity according to the embodiment, the first and second comparative examples. The measurement result of the adhering of carrier is shown in FIG. 9. Referring to FIG. 9, the reference character (Vd) represents a potential of developing bias, and the reference character (Vb) represents a potential of a grid of the charging device. As the potential (Vb) is substantially equal to the surface potential of the photoreceptor, the adhering of carrier is measured by controlling the potential (Vd) and (Vb). The number of adhered carrier was converted into the number per 75 square centimeter area. The volume resistivity of the magnetic carrier was adjusted by the amount of carbon black internally added to the resin layer.

When performing continuous copying operations of half-tone full images under the above-described conditions, as illustrated in FIG. 9, even though the magnetic carrier having a weight average particle diameter of 35 $\mu$m is used in the embodiment and the first and second comparative examples, the number of adhered carrier is almost none when the potential (Vd-Vb) is 300V in the embodiment. Therefore, images are not affected by magnetic carrier in the embodiment. However, in the first and second comparative examples, the number of adhered carrier is 200 or greater when the potential (Vd-Vb) is 300V. As a result, white spots occur on an image on a transfer material P, thereby deteriorating the image quality.

As described above, if the intermediate transfer element 10 has a relatively great hardness and a low elasticity, the intermediate transfer element 10 is hard to deform. In this case, when a toner image with adhered magnetic carrier is transferred from the intermediate transfer element 10 to a transfer material P at the secondary transfer nip part, a space is formed between the intermediate transfer element 10 and the transfer material P due to the magnetic carrier, so that toner existing around the magnetic carrier can not contact the transfer material P due to the space and can not be transferred onto the transfer material P properly. In the present embodiment, because the intermediate transfer element 10 includes an elastic layer, the intermediate transfer element 10 can flexibly deform. Thereby, a toner image and a transfer material P can adequately contact each other without forming a space between the toner image and the transfer material P. Further, using the magnetic carrier having a weight average particle diameter in a range of 10 $\mu$m to 80 $\mu$m, it can typically avoid forming a space between the intermediate transfer element 10 and the transfer material P, thereby obviating an inferior transfer of a toner image.

Alternatively, using the magnetic carrier having a weight average particle diameter in a range of 10 $\mu$m to 40 $\mu$m, a high quality image in which thin lines are sharply reproduced can be obtained while obviating occurrence of white spots.

The present invention has been described with respect to the embodiment as illustrated in the figures. However, the present invention is not limited to the embodiments and may be practiced otherwise.

The present invention has also been described with respect to a copying machine as an example of an image forming apparatus. However, the present invention may be applied to other image forming apparatuses such as a printer or a facsimile machine.

Further, in the above-described color image forming apparatus, the order of forming images of respective colors and/or the arrangement of the developing devices for respective colors are not limited to the ones described above and can be practiced otherwise.

Moreover, the present invention is applied to a tandem type color image forming apparatus including a plurality of photoreceptors and developing devices for forming images of respective colors. Alternatively, the present invention may be applied to a color image forming apparatus employing a revolver type developing device including a plurality of developing units containing toner of respective colors. When using a revolver type developing device, an image forming apparatus includes a single photoreceptor.

Numerous additional modifications and variations of the present invention are possible in light of the above teachings. It is therefore to be understood that within the scope of the appended claims, the present invention may be practiced otherwise than as specifically described herein.

What is claimed:

1. An image forming apparatus, comprising:

at least one latent image carrier configured to carry an electrostatic latent image;

at least one developing device configured to develop the electrostatic latent image with developer to form a toner image on the at least one latent image carrier;

an intermediate transfer element including an elastic layer and configured to carry the toner image transferred from the at least one latent image carrier;

a primary transfer device including the intermediate transfer element and configured to transfer the toner image on the at least one latent image carrier onto the intermediate transfer element; and a secondary transfer device configured to transfer the toner image carried by the intermediate transfer element onto a transfer material, wherein the developer includes toner and magnetic carrier, and a weight average particle diameter of the magnetic carrier is in a range of 10 $\mu$m to 80 $\mu$m, and wherein a volume resistivity of the magnetic carrier is in a range of $1\times10^{8}$ Ω·cm to $1\times10^{15}$ Ω·cm when a direct current voltage of 250V is applied to the magnetic carrier.

2. An image forming apparatus, comprising:

at least one latent image carrier configured to carry an electrostatic latent image;

at least one developing device configured to develop the electrostatic latent image with developer to form a toner image on the at least one latent image carrier;

an intermediate transfer element including an elastic layer and configured to carry the toner image transferred from the at least one latent image carrier;

a primary transfer device including the intermediate transfer element and configured to transfer the toner image on the at least one latent image carrier onto the intermediate transfer element; and a secondary transfer device configured to transfer the toner image carried by the intermediate transfer element onto a transfer material, wherein the developer includes toner and magnetic carrier, and a weight average particle diameter of the magnetic carrier is in a range of 10 μm to 80 μm, and wherein a line pressure applied to the toner image transferred from the intermediate transfer element to the transfer material is in a range of 20 g/cm to 110 g/cm.

3. A two-component developer for use in an image forming apparatus including at least one latent image carrier that carries an electrostatic latent image; at least one developing device that develops the electrostatic latent image with the two-component developer to form a toner image on the at least one latent image carrier; an intermediate transfer element including an elastic layer that carries the toner image transferred from the at least one latent image carrier; a primary transfer device including the intermediate transfer element and that transfers the toner image on the at least one latent image carrier onto the intermediate transfer element; and a secondary transfer device that transfers the toner image carried by the intermediate transfer element onto a transfer material, the two-component developer comprising:

toner and magnetic carrier, wherein a weight average particle diameter of the magnetic carrier is in a range of 10 μm to 80 μm, wherein a volume resistivity of the magnetic carrier is in a range of $1\times10^{8}$ Ω·cm to $1\times10^{15}$ Ω·cm when a direct current voltage of 250V is applied to the magnetic carrier.

4. A two-component developer for use in an image forming apparatus including at least one latent image carrier that carries an electrostatic latent image; at least one developing device that develops the electrostatic latent image with the two-component developer to form a toner image on the at least one latent image carrier; an intermediate transfer element including an elastic layer that carries the toner image transferred from the at least one latent image carrier; a primary transfer device including the intermediate transfer element and that transfers the toner image on the at least one latent image carrier onto the intermediate transfer element; and a secondary transfer device that transfers the toner image carried by the intermediate transfer element onto a transfer material, the two-component developer comprising:

toner and magnetic carrier, wherein a weight average particle diameter of the magnetic carrier is in a range of 10 μm to 80 μm, wherein a line pressure applied to the toner image transferred from the intermediate transfer element to the transfer material is in a range of 20 g/cm to 110 g/cm.

5. An intermediate transfer element for use in an image forming apparatus including at least one latent image carrier that carries an electrostatic latent image; at least one developing device that develops the electrostatic latent image with developer to form a toner image on the at least one latent image carrier, the developer including toner and magnetic carrier, and a weight average particle diameter of the magnetic carrier being in a range of 10 μm to 80 μm; a primary transfer device including the intermediate transfer element and that transfers the toner image on the at least one latent image carrier onto the intermediate transfer element; and a secondary transfer device that transfers the toner image carried by the intermediate transfer element onto a transfer material, the intermediate transfer element comprising:

an elastic layer having a rubber hardness in a range of 40 degrees to 70 degrees in JIS-A of Japanese Industrial Standards, and having a thickness in a range of 50 μm to 300 μm, wherein a volume resistivity of the magnetic carrier is in a range of $1\times10^{8}$ Ω·cm to $1\times10^{15}$ Ω·cm when a direct current voltage of 250V is applied to the magnetic carrier.

6. An intermediate transfer element for use in an image forming apparatus including at least one latent image carrier that carries an electrostatic latent image; at least one developing device that develops the electrostatic latent image with developer to form a toner image on the at least one latent image carrier, the developer including toner and magnetic carrier, and a weight average particle diameter of the magnetic carrier being in a range of 10 μm to 80 μm; a primary transfer device including the intermediate transfer element and that transfers the toner image on the at least one latent image carrier onto the intermediate transfer element; and a secondary transfer device that transfers the toner image carried by the intermediate transfer element onto a transfer material, the intermediate transfer element comprising:

an elastic layer having a rubber hardness in a range of 40 degrees to 70 degrees in JIS-A of Japanese Industrial Standards, and having a thickness in a range of 50 μm to 300 μm, wherein a line pressure applied to the toner image transferred from the intermediate transfer element to the transfer material is in a range of 20 g/cm to 110 g/cm.

7. An image forming apparatus, comprising:

carrying means for carrying an electrostatic latent image;

developing means for developing the electrostatic latent image with developer to form a toner image on the carrying means;

intermediate carrying means including an elastic layer for carrying the toner image transferred from the carrying means;

primary transferring means including the intermediate carrying means for transferring the toner image on the carrying means onto the intermediate carrying means; and secondary transferring means for transferring the toner image carried by the intermediate carrying means onto a transfer material, wherein the developer includes toner and magnetic carrier, and a weight average particle diameter of the magnetic carrier is in a range of 10 μm to 80 μm, and wherein a volume resistivity of the magnetic carrier is in a range of $1\times10^{8}$ Ω·cm to $1\times10^{15}$ Ω·cm when a direct current voltage of 250V is applied to the magnetic carrier.

8. An image forming apparatus, comprising:

carrying means for carrying an electrostatic latent image;

developing means for developing the electrostatic latent image with developer to form a toner image on the carrying means;

intermediate carrying means including an elastic layer for carrying the toner image transferred from the carrying means;

primary transferring means including the intermediate carrying means for transferring the toner image on the carrying means onto the intermediate carrying means; and secondary transferring means for transferring the toner image carried by the intermediate carrying means onto a transfer material, wherein the developer includes toner and magnetic carrier, and a weight average particle diameter of the magnetic carrier is in a range of 10 $\mu$m to 80 $\mu$m, and wherein a line pressure applied to the toner image transferred from the intermediate transfer element to the transfer material is in a range of 20 g/cm to 110 g/cm.

* * * * *